US007430764B2

(12) United States Patent
Yang

(10) Patent No.: US 7,430,764 B2
(45) Date of Patent: Oct. 7, 2008

(54) STAMP STRUCTURE OF A PATTERN ON A SURFACE OF WRIST BAND OF A HAEMONAMOMETER

(76) Inventor: Kun-Tu Yang, 3F., No. 212-2, Heping Rd., Jhonghe City, Taipei County (TW)

( * ) Notice: Subject to any disclaimer, the term of this patent is extended or adjusted under 35 U.S.C. 154(b) by 262 days.

(21) Appl. No.: 11/335,733

(22) Filed: Jan. 20, 2006

(65) Prior Publication Data

US 2007/0169248 A1 Jul. 26, 2007

(51) Int. Cl.
*A41D 19/00* (2006.01)

(52) U.S. Cl. ..... 2/162

(58) Field of Classification Search ..... 2/59, 2/162, 170

See application file for complete search history.

(56) References Cited

U.S. PATENT DOCUMENTS 2,998,695 A * 9/1961 Cornett ..... 368/282
4,277,842 A * 7/1981 Richards ..... 368/282
4,779,249 A * 10/1988 Rappaport ..... 368/276
6,234,668 B1 * 5/2001 Cooper ..... 368/281

* cited by examiner

*Primary Examiner*—Katherine Moran
(74) *Attorney, Agent, or Firm*—Troxell Law Office, PLLC

(57) ABSTRACT

A stamp structure of a pattern on a surface of wrist band of a haemonamometer is constituted by a strap of fiber cloth, a lining, and a fluffy cloth of linking tape. A plurality of large and small holes of different shapes is located on proper positions of the strap of fiber cloth, and a three-dimensional pattern is branded by a heating and pressing through a die-cast process, such that the wrist band can be assembled with an electronic meter to form into a watch-type haemonamometer which is provided with an advantage of highly improved texture.

4 Claims, 8 Drawing Sheets

STAMP STRUCTURE OF A PATTERN ON A SURFACE OF WRIST BAND OF A HAEMONAMOMETER

BACKGROUND OF THE INVENTION (a) Field of the Invention

The present invention relates to a stamp structure of a pattern on a surface of wrist band of a haemonamometer, and more particularly to a stamp structure that can be applied to a soft strap of fiber cloth for being finished into a special pattern, so as to increase an entire texture of the haemonamometer and to form into a logo pattern on the wrist band, thereby increasing a benefit of advertisement.

(b) Description of the Prior Art

For a conventional haemonamometer, a soft strap of cloth is combined with an electronic meter, in order to install the current haemonamometer on a pulse position of wrist for measuring a true blood pressure and heart beat of a human. However, as the strap of cloth of existing haemonamometer is a single color design, an appearance and texture are extremely alike for the same kind of haemonamometer product of each vendor, which will not be able to effectively stand out a quality of good merchandise.

If an extra printed cloth is purposely sewn on the strap of wrist band to pursue a breakthrough of the appearance and texture of the wrist band of haemonamometer, a cost of raw material or cost of working hours of finishing will be increased, which will adversely affect an improvement of competitiveness of the products.

In addition, if a producer is to print a logo pattern on the small and compact haemonamometer, it can only be printed on a limited casing of the electronic meter. Therefore, the logo pattern cannot be effectively and clearly seen by aged people, which is the largest population of users of the haemonamometer. Accordingly, if the pattern can be designed on the wrist band of large area to enable a user to identify it more easily, the benefit of advertisement of a producer will be greatly increased.

SUMMARY OF THE INVENTION

Accordingly, the primary object of the present invention is to provide a stamp structure of a pattern on a surface of wrist band of a haemonamometer wherein all kinds of design patterns can be finished and manufactured on the surface of wrist band, including a creative pattern or a logo of advertisement, and the structure is provided with a soft strap of cloth with a comfortable sense of touching, so as to increase a throughput and to reduce a manufacturing cost of entire product.

Accordingly, the present invention is composed of a strap of fiber cloth, a lining, and a fluffy cloth of linking tape, wherein a plurality of holes of different shapes and diameters is located on proper positions of the strap of fiber cloth which is heated, pressed, and branded into a three-dimensional pattern through a die-cast process; and a male linking tape is located at one side of the strap of fiber cloth. The lining and the fluffy cloth of linking tape are sewn on a bottom surface of the strap of fiber cloth, so as to fill an air-filled air bag and a plastic fixing piece into an interlining of the strap of fiber cloth, such that nozzles of the air bag and locking tenons on the fixing piece are extended out of the holes of strap of fiber cloth, thereby assembling an electronic meter with the nozzles and the locking tenons to form into a watch-type haemonamometer.

For the wrist band of haemonamometer of the present invention, a three-dimensional anaglyptic pattern of high texture will be formed on the surface of strap of fiber cloth, and a specific logo pattern can be designed on the band with a computer, thereby enabling an appearance of product to be more delicate and gracious in texture.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
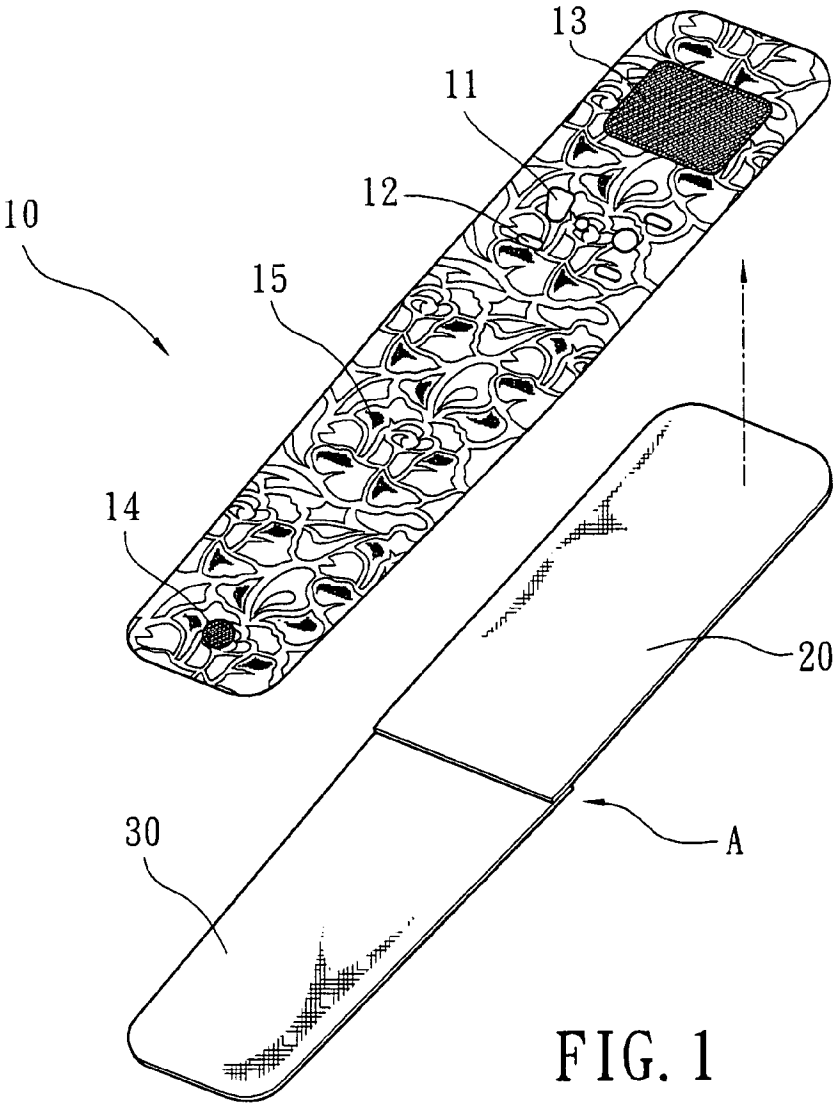
FIG. 1 shows a schematic exploded view of components of the present invention before being assembled.
Figure 2:
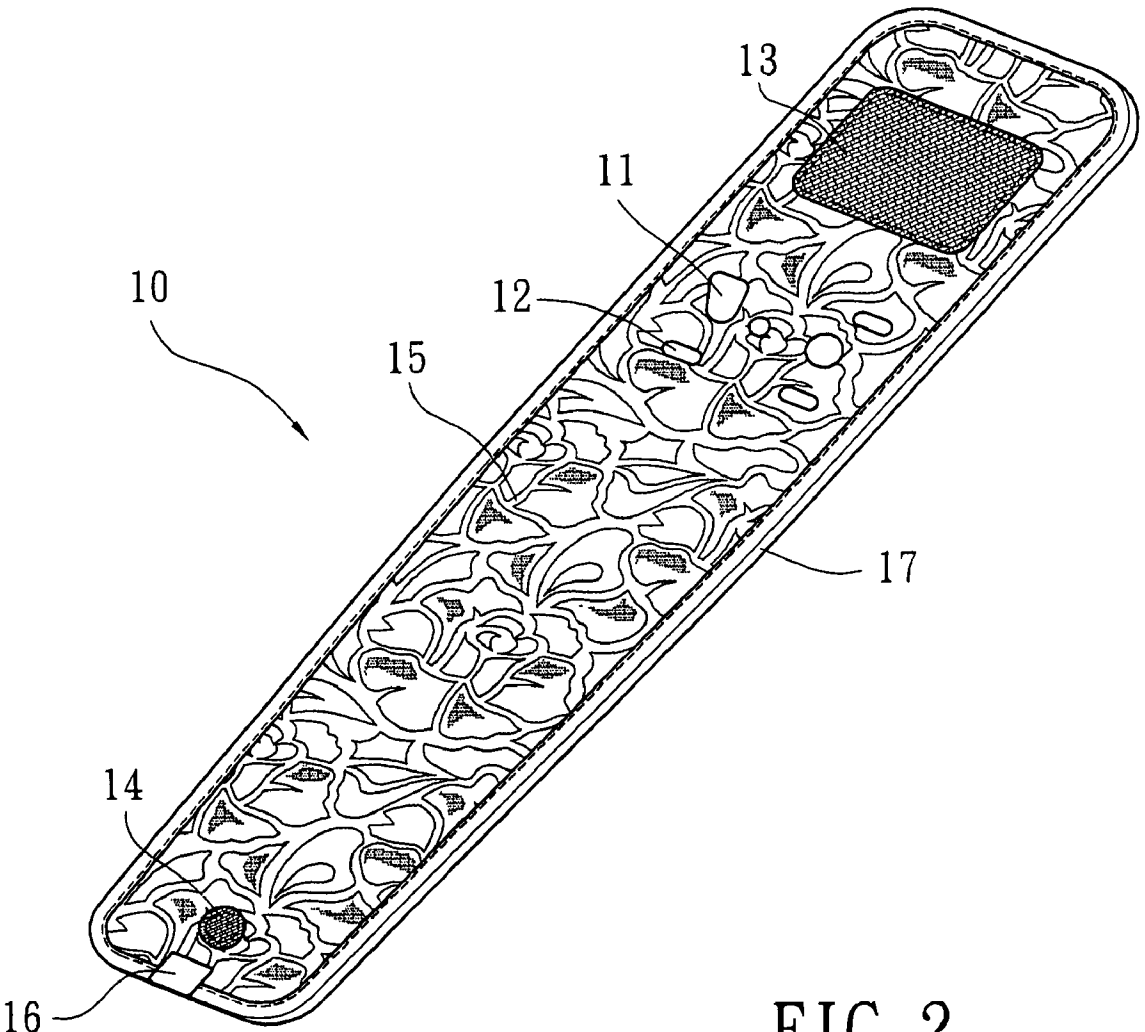
FIG. 2 shows a schematic view of an appearance of the present invention after being assembled.

Referring to FIG. 1 and FIG. 2, a stamp structure of a pattern on a surface of wrist band of a haemonamometer of the present invention comprises primarily a strap of fiber cloth 10, a lining 20, and a fluffy cloth of linking tape 30. A plurality of large holes 11 and small holes 12 of different shapes is located on proper positions of the strap of fiber cloth 10, a male linking tape 13 is sewn and fixed at one side of the strap, a small piece of male linking tape 14 is sewn and fixed at the other side of the strap, and an exterior surface in a front of the strap of fiber cloth is branded into a specific pattern 15. The lining 20 is of about a half length of the strap of fiber cloth 10, and the other fluffy cloth of linking tape 30 is of a length larger than a half length of the strap of fiber cloth 10, such that the total length of lining 10 and fluffy cloth of linking tape 30 is greater than the total length of the strap of fiber cloth 10. Therefore, when the lining 20 and the fluffy cloth of linking tape 30 are sewn on a bottom surface of the strap of fiber cloth 10, an overlapped surface A will be formed at an intersection. After sewing all pieces to an integrated body, a metallic plate 16 is riveted at a bottom end, and a strip of delicate decoration is sewn at a periphery of the entire strap of fiber cloth 10. In another feasible implementation, the total length of the lining and the fluffy cloth of linking tape can be smaller than the total length of strap of fiber cloth, such that the lining 20 and the fluffy cloth of linking tape 30 are separately sewn on the bottom surface of strap of fiber cloth 10. Although there is no overlapped surface for the lining and the fluffy cloth of linking tape, they are only required to be sewn and fixed.

In order to have a finer and more delicate pattern 15 on a top surface of the aforementioned strap of fiber cloth 10, a laser carving technique, an electric discharging technique, an electrolysis etching technique, or a digital computer numerical control (CNC) cutting technique can be applied to carve into all kinds of anaglyptic patterns on a surface of a template. Therefore, by a principle that an artificial fiber cloth can be shrunken upon being heated and pressed, the strap of fiber cloth 10 is put into a molding tool to be branded into the pattern 15 on its surface through a die-cast technique of pressing and heating by the molding tool, thereby improving an overall texture of the wrist band. On the other hand, in another preferred implementation, a three-dimensional anaglyptic pattern is carved on a surface of roller, and is quickly printed on the fiber cloth 10 through a heating and rolling of the roller.

Figure 3:
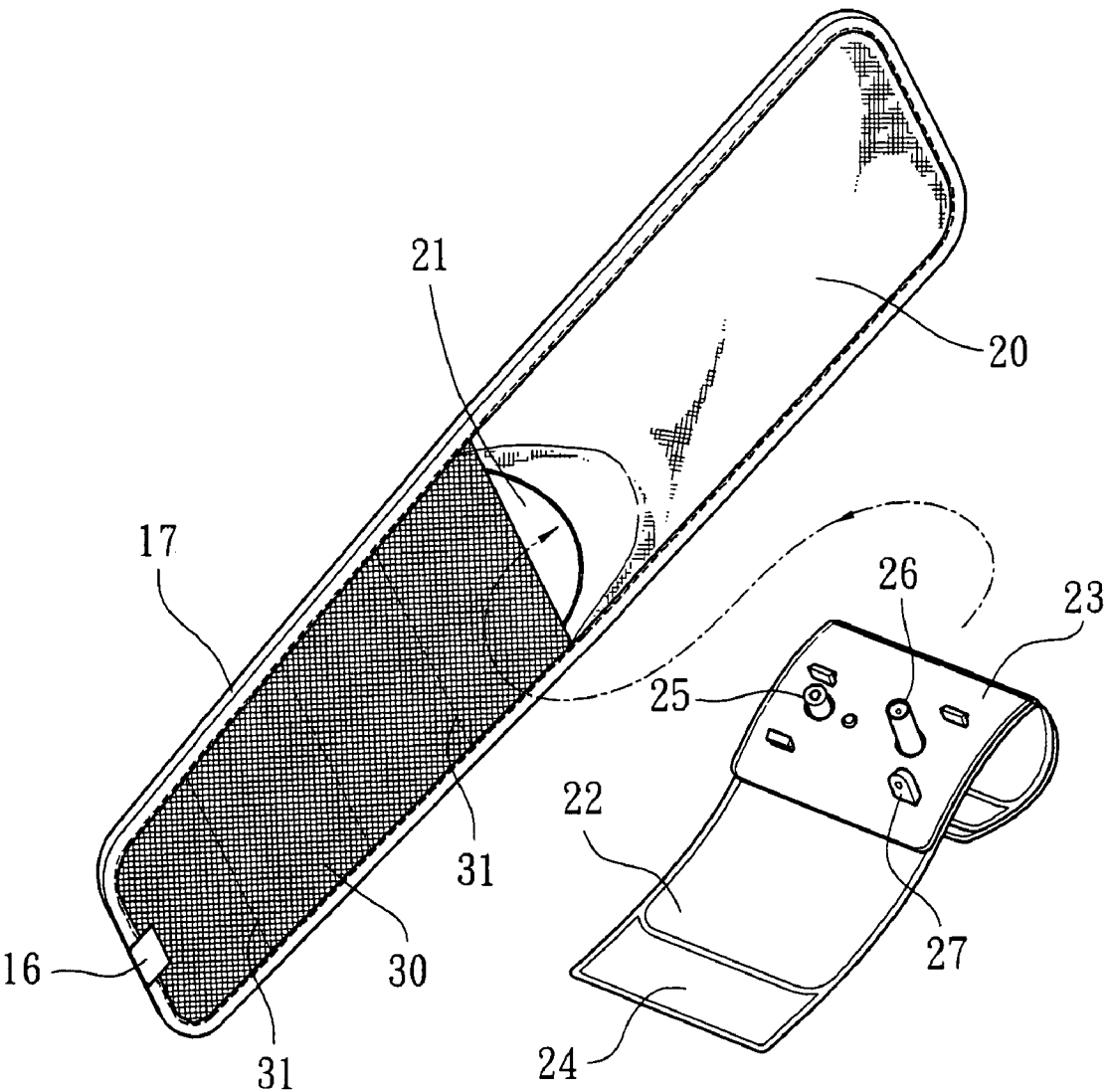
FIG. 3 shows a schematic view of assembling a fixing piece in an interlining of the present invention.

Referring to FIG. 3, after sewing the wrist band of present invention, an interlining 21 will be formed between the fiber cloth 10 and the lining 20 and the fluffy cloth of linking tape 30, and a plurality of seams 31 is sewn on a bottom surface between the fluffy cloth of linking tape 30 and the fiber cloth 10, to enhance their strength of assembling. An inflatable air bag 22 is assembled into a plastic fixing piece 23 which is in a bended shape and whose tail end is left with a short extension piece 24, forming two thermal seals to assure an air-tight of the air bag 22. An inlet nozzle 25 and an outlet nozzle 26 are protruded on a surface of plastic fixing piece 23 which is provided with a plurality of locking tenons 27, such that the air bag 22 and the plastic fixing piece 23 can be filled into an interior of the interlining 21, followed by sewing an intersection of overlapped surface A at an opening of the interlining to enclose the air bag 22.

Figure 4:
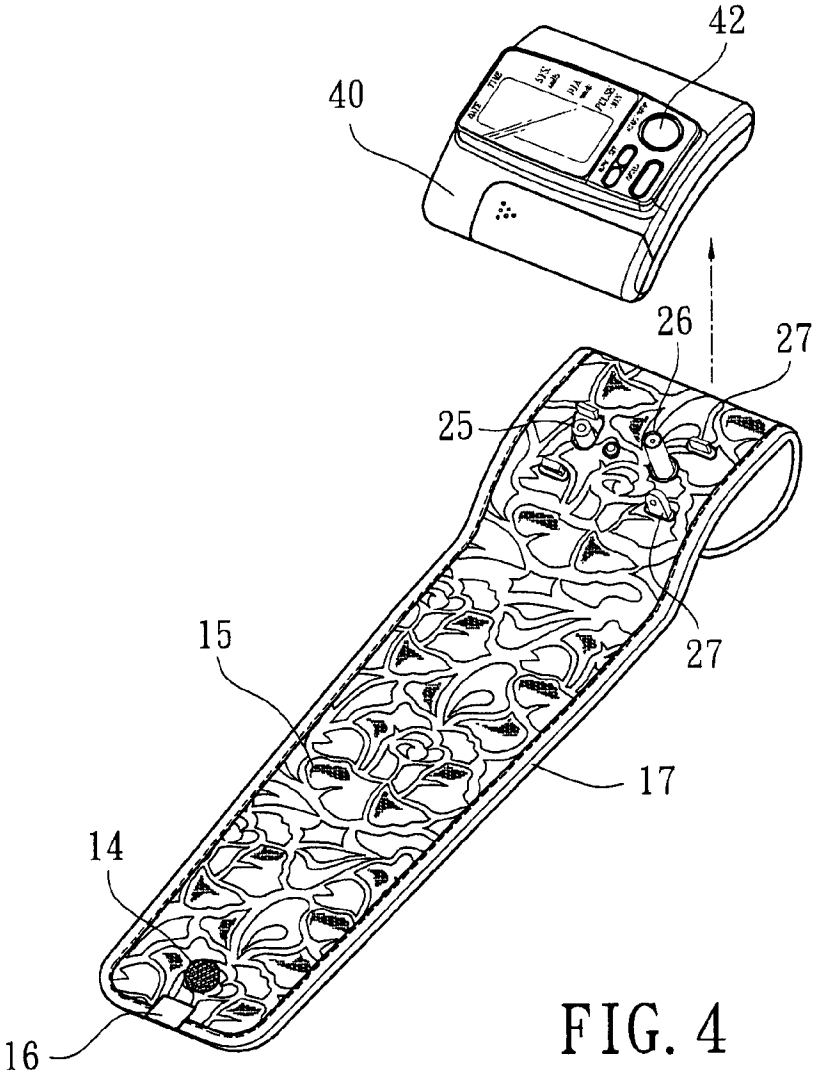
FIG. 4 shows a schematic view of assembling an electronic meter of the present invention.
Figure 5:
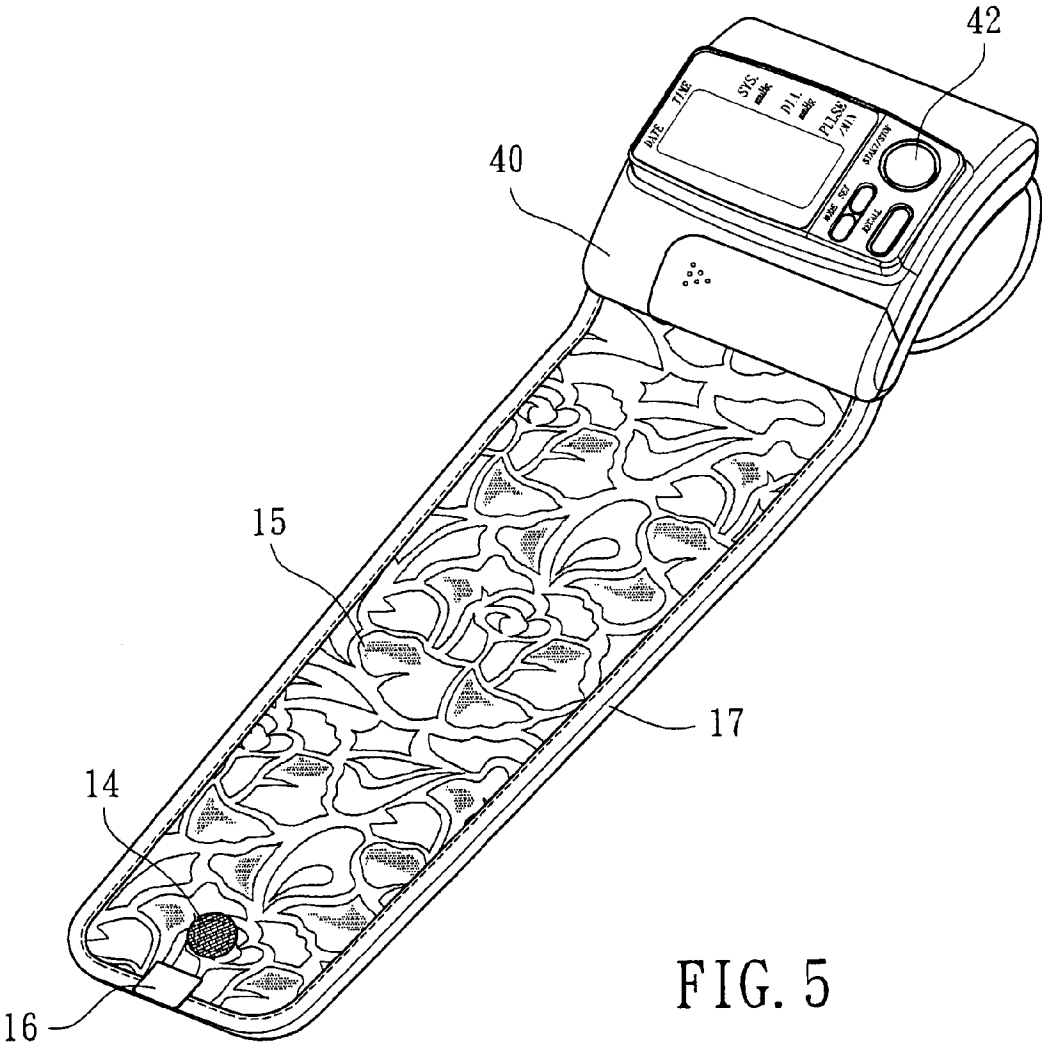
FIG. 5 shows a schematic view of an appearance of the present invention after being assembled into a haemonamometer.

Referring to FIG. 4, the inlet nozzle 25, outlet nozzle 26, and plurality of locking tenons 27 are protruded out of the large holes 11 and small holes 12 at a front surface of the wrist band, followed by assembling an electronic meter 40 on all nozzles 25, 26 and locking tenons 27, thereby forming into a watch-type haemonamometer (as shown in FIG. 5).

Figure 6:
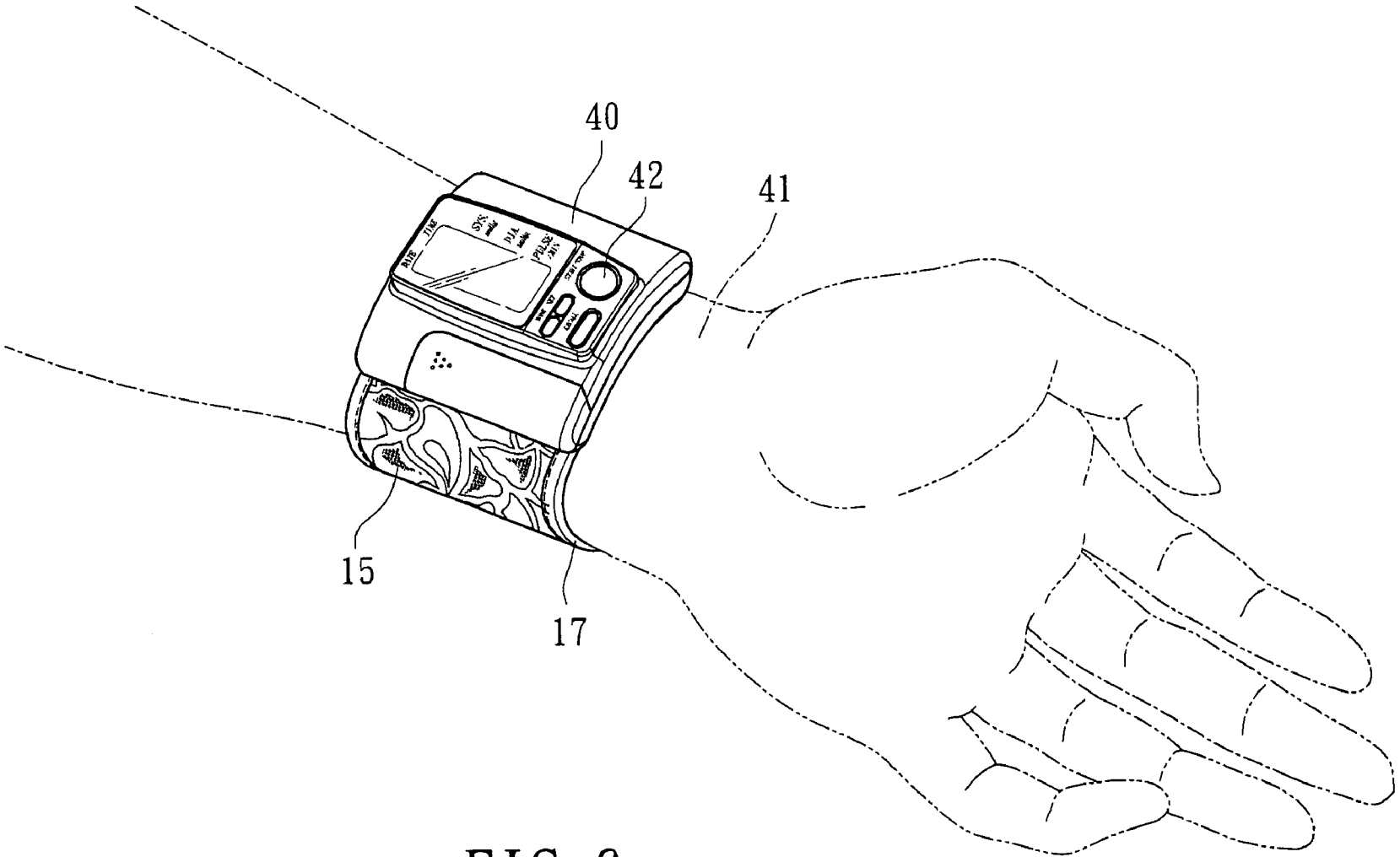
FIG. 6 shows a schematic view of an example of measuring a blood pressure of the present invention.

Referring to FIG. 5 and FIG. 6, after manufacturing the wrist band of present invention, it is assembled with the electronic meter 40 to form into a watch-type haemonamometer which is a compact tool and is easy to carry personally. For a personal with hyper-tension or diabetics, it can be used to measure a blood pressure at any time to monitor a condition of health, and to prevent from an incidence of cardiovascular disease such as a paralysis. When using the haemonamometer, an arc part of the plastic fixing piece 23 is sheathed on a wrist 41, and the extended fiber cloth 10 is wrapped around the wrist to stick the bottom fluffy cloth of linking tape 30 to the male linking tape 13, whereas a tail end of the over-length fiber cloth 10 can be folded backward to be stuck by the small piece of male linking tape 14. Therefore, when an inflating button 42 is pressed down, the air bag 22 is charged with air and inflated, and a diastolic pressure, a systolic pressure, and a number of heart beats can be displayed on a liquid crystal screen through a monitoring of related electronic circuit, enabling a user to clearly understand a health condition oneself. In addition, through the specially designed pattern 15 on the surface of wrist band, the texture of entire haemonamometer can be improved to manifest a good quality.

Figure 7:
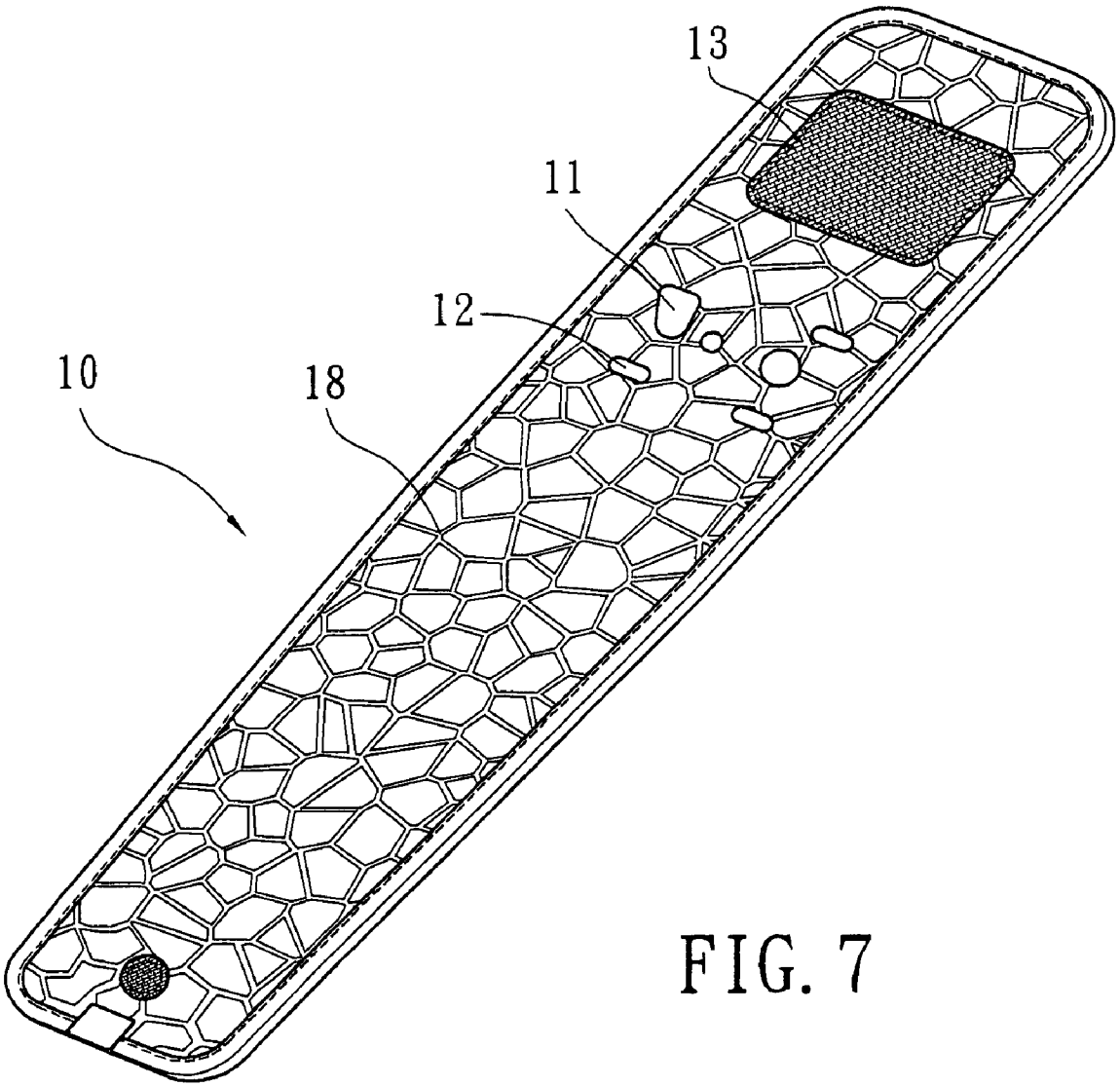
FIG. 7 shows a schematic view of an appearance of a second embodiment of the present invention.
Figure 8:
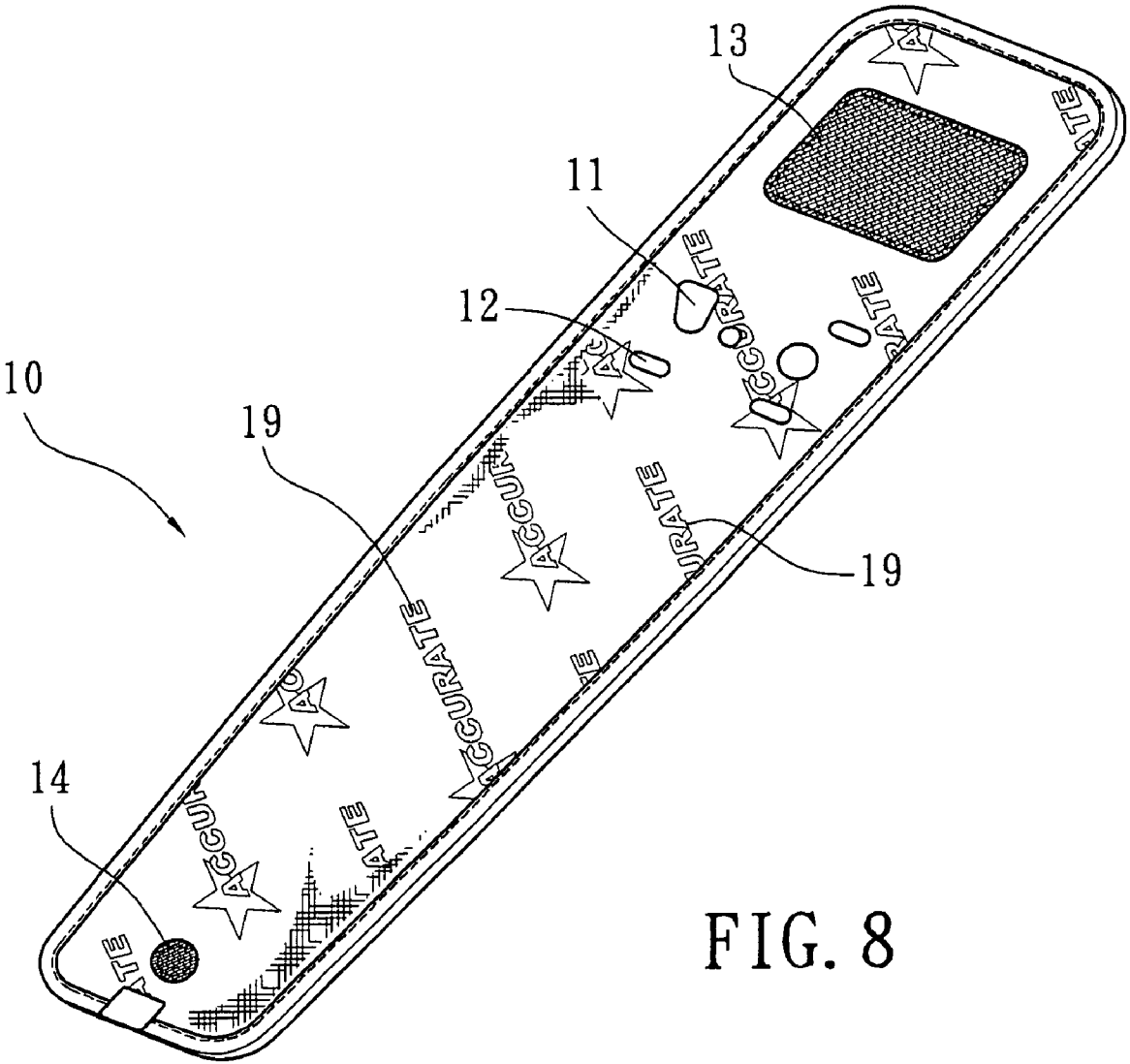
FIG. 8 shows a schematic view of an appearance of a third embodiment of the present invention.

Referring to FIG. 7, an image on the surface of fiber cloth 10 can be designed as other pattern to manifest a new beautiful appearance of stone texture 18. Referring to FIG. 8, by an application of the structural design of present invention, the branded pattern can be made into a logo pattern 19, so as to achieve a benefit of advertisement for the wrist band of haemonamometer.

Accordingly, the present invention is to effectively provide a pattern or logo design on the soft wrist band, to effectively improve a quality of product and to be able to be applied to a creation of pattern on a haemonamometer, without sewing with any engraved plate or cut piece.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A stamp structure of a pattern on a surface of wrist band of a haemonamometer comprising a strap of fiber cloth, a lining, and a fluffy cloth of linking tape, wherein a back surface of the strap of fiber cloth, which is in a shape of long strip, is sewn with the lining and the fluffy cloth of linking tape, an outermost surface of the strap of fiber cloth is branded into a three-dimensional pattern by a heating and pressing through a die-cast process after being carved into an anaglyptic pattern, a side of the strap of fiber cloth is installed with a male linking tape rod, and a plurality of large and small holes of different shapes is located on the strap of fiber cloth, the large and small holes being located to expose a portion of the liner underlying the strap of fiber cloth; the lining being shorter than the strap of fiber cloth, and the fluffy cloth of linking tape also being shorter than the strap of fiber cloth; the strap of fiber cloth, the lining, and the fluffy cloth of linking tape being sewn together to form into a wrist band of haemonamometer, wherein the total length of lining and fluffy cloth of linking tape is larger than the total length of strap of fiber cloth, such that the lining and the fluffy cloth of linking tape are sewn on a bottom surface of the strap of fiber cloth, which creates an overlapped surface at an intersection, wherein the strap of fiber cloth is sewn on an opposite end of the male linking tape, and the other side is sewn with a small piece of male linking tape.

2. The stamp structure of a pattern on a surface of wrist band of a haemonamometer according to claim 1, wherein a metallic plate is riveted on a bottom end of the wrist band formed by sewing the strap of fiber cloth, the lining, and the fluffy cloth of linking tape.

3. The stamp structure of a pattern on a surface of wrist band of a haemonamometer according to claim 1, wherein a strip of delicate decoration is sewn on a periphery of entire wrist band formed by sewing the strap of fiber cloth, the lining, and the fluffy cloth of linking tape.

4. The stamp structure of a pattern on a surface of wrist band of a haemonamometer according to claim 1, wherein a three-dimensional anaglyptic pattern is carved on a surface of roller, and is quickly printed on the fiber cloth through a heating and rolling of the roller, thereby branding into an anaglyptic pattern on a front surface of the strap of fiber cloth.

* * * * *